US005896944A

United States Patent [19]

McMillian et al.

[11] Patent Number: 5,896,944

[45] Date of Patent: Apr. 27, 1999

[54] ADJUSTABLE RAIL BARRICADE FOR WORKING ON A ROOF

[76] Inventors: James D. McMillian, 6406 Elkhart, Lubbock, Tex. 79424; Virgil R. Wages, 4910 7th St., Lubbock, Tex. 79416; Walton J. Austin, 519 40th St., Lubbock, Tex. 79404

[21] Appl. No.: 08/427,951

[22] Filed: Apr. 24, 1995

[51] Int. Cl.[6] ..... E04G 1/36

[52] U.S. Cl. ..... 182/45; 182/113; 256/65

[58] Field of Search ..... 182/45, 113; 256/65

[56] References Cited

U.S. PATENT DOCUMENTS

| | | | |
|---|---|---|---|
| 822,658 | 6/1906 | Emberson . | |
| 1,152,685 | 9/1915 | Winn et al. . | |
| 1,363,864 | 12/1920 | Grush . | |
| 2,840,424 | 6/1958 | Broderick | 182/45 |
| 2,871,927 | 2/1959 | Materi . | |
| 3,853,203 | 12/1974 | Werner et al. | 182/113 |
| 3,867,997 | 2/1975 | Hyslop, Jr. | 182/113 |
| 3,880,405 | 4/1975 | Brueske | 182/113 X |
| 3,901,481 | 8/1975 | Probst | 182/113 X |
| 4,236,698 | 12/1980 | Compte | 182/113 X |
| 4,458,783 | 7/1984 | Stakes | 182/45 X |
| 4,607,724 | 8/1986 | Hillberg . | |
| 4,666,131 | 5/1987 | Kettelkamp, Sr. et al. | 182/113 X |
| 4,669,577 | 6/1987 | Werner | 182/113 |
| 5,143,170 | 9/1992 | Hunt et al. . | |
| 5,282,597 | 2/1994 | Babcock . | |
| 5,287,944 | 2/1994 | Woodyard . | |
| 5,361,558 | 11/1994 | Thornton et al. . | |
| 5,377,958 | 1/1995 | Palmer | 182/113 X |
| 5,379,859 | 1/1995 | Pigman | 182/45 |
| 5,431,372 | 7/1995 | Kostelecky | 182/45 X |
| 5,515,941 | 5/1996 | Palmer et al. | 182/113 X |

OTHER PUBLICATIONS

"Roof Anchors", Advertising Material of DBI/SALA, P.O. Box 46, Red Wing, MN 55066, pp. 1–4, Date Unknown.

*Primary Examiner*—Michael J. Carone
*Assistant Examiner*—Victor Batson
*Attorney, Agent, or Firm*—Royston Rayzor Vickery Novak & Druce

[57] ABSTRACT

A portable adjustable rail barricade for working on a roof generally comprising a plurality of removably supported rail members pivotally attached to a base member adapted for releasable engagement upon the surface of a roof. The pivotal nature of the rail member attachment allows the rail barricade to be substantially vertically oriented upon various roofs with widely ranging roof pitches. Additionally, a toe rail is provided at a distance away from the pivotal attachment of the rail members for preventing objects from falling from the roof. Because the toe rail is at a distance away from the pivotal attachment of the rail members, there is formed an extended base for the adjustable rail barricade, serving to increase the barricade's efficacy toward providing a secure barrier against falls.

1 Claim, 1 Drawing Sheet

ADJUSTABLE RAIL BARRICADE FOR WORKING ON A ROOF

BACKGROUND OF THE INVENTION

1) Field of the Invention

The present invention relates generally to roofing safety devices, and more particularly to roofing safety devices utilizing a barricade.

2) Description of the Related Art

Roofing safety devices are well known in the art of roofing. Patents that have issued concerning roofing safety devices include U.S. Pat. No. 822,658 to Emberson for Scaffolding and U.S. Pat. No. 1,152,685 to Winn et al. for Roof Scaffold Bracket. The Emberson patent includes disclosure of a roofing safety device that comprises two parallel angled members extending downward from the ridge of the roof. An elongated brace is connected between the angled members. The area between the angled members and above the elongated brace provides an area where a roofer can work safely. Winn et al. includes disclosure of a triangular cage secured by a hook extending over the ridge of the roof. The hook is attached to a shingle on the opposite side of the cage. The hook is connected to the cage by a chain extending over the ridge of the roof. A roofer can safely work within the confines of the cage.

Examining these devices however reveals significant shortcomings. One shortcoming is that a worker must ascend to the ridge of the roof to install the device and thus is exposed to the risk of falling from the roof during installation. Furthermore, new Occupational Safety and Health Agency (OSHA) regulations effective as of Feb. 6, 1995, require that for persons working on steep sloped roofs, either a safety net be provided below the roof, a safety line be attached to a personal harness worn by the worker, or a guardrail be extended along the lower eaves of the roof. By the regulations, a steep sloped roof is defined as those having a four inch on twelve inch pitch or greater. If a guardrail is utilized, then the guardrail must have a height of at least thirty-nine (39) inches and be strong enough to withstand a two hundred pound force exerted anywhere along its length.

An additional regulation requires the provision of a toe rail located adjacent to the roof's surface and positioned below the area to be roofed. The toe rail serves as a barrier or catch mechanism for loose items that may otherwise slide down and off of the roof potentially harming persons below.

In light of these new regulations, some presently available designs do not meet the OSHA requirements for steep sloped roofs. Other designs that could possibly meet the regulations would require that the device be installed at the ridge of the roof and extend from the ridge to the eaves of the roof. Installing these designs would be a tedious and cumbersome process.

In summary, the previously described roof safety devices which erect barricades around roof workers to protect them from falls either do not meet current OSHA regulations or are unduly cumbersome because of installation requirements.

SUMMARY OF THE INVENTION

The current invention is an adjustable rail barricade providing several advantages over other safety devices. The invention forms a portable barricade that can be quickly erected around the eaves of the roof. The invention is designed to meet current OSHA regulations by providing a barricade that comprises a pair of guardrails, one of which is forty- two (42) inches in height which well exceeds the 39 inch requirement, and a toe rail to prevent items from sliding off of the roof. Additionally, the elongated post upon which the guardrails rest is pivotally connected to the base of the barricade. Because the orientation of the elongated post is adjustable, the barricade can be utilized on various pitches of roofs and still maintain the post in a substantially vertical position. The invention is designed to operate on roofs with pitch ranges from zero inch on twelve inch pitch to eight inch on twelve inch pitch, though the invention is specifically adapted to operate upon roofs having a four inch on twelve inch pitch to roofs with an eight inch on twelve inch pitch. Furthermore, in the preferred embodiment the barricade is quickly erected upon a roof by nailing a plurality of anchor supports to the roof via a plurality of anchor plates. Rails are inserted into the anchor supports to complete the barricade. To move the barricade, rails are removed from the anchor supports, the nails are removed from the anchor plates, and the anchor supports are then moved to the new location.

It is an object of the current invention to provide a portable barricade that satisfies government regulations.

It is a further object of the present invention to provide a portable barricade that can be adjusted for variously pitched roofs.

It is an additional object of the present invention to provide a barricade that is erected and moved easily.

Another object of the present invention is to provide a method of erecting a barricade around the eaves of a roof.

In accordance with these aims, one embodiment of the present invention is a portable barricade for working on a roof comprising an anchor support coupled to a first rail member. The anchor support is positioned substantially at the eave of the roof.

Another embodiment of the present invention is a portable barricade for use while working on a roof comprising an anchor support including an elongated member and a first rail member. The first rail member is detachably coupled with the elongated member.

A further embodiment of the present invention is a method of constructing a portable barricade around the eaves of a roof comprising the steps of coupling a first anchor support to the eaves of the roof. The next step is coupling a second anchor support to the eaves of the roof. After coupling the second anchor support to the roof, at least one rail member is placed on the first and second anchor supports.

An additional embodiment of the present invention is an adjustable rail support for a portable roofing safety device. The adjustable rail support comprises a base, an extension member, and receivers. The base is coupleable to a roof for releasable engagement therewith and is substantially parallel to an upper surface of the roof when coupled thereto. The extension member is pivotally coupled to the base for movement relative thereto through a range of motion. The range of motion is of sufficient degree to permit the extension member to be substantially vertically oriented when installed upon roofs of variable pitch. The extension member can be lockable into a fixed engagement with the base within the range of motion. Receivers are coupled to the extension member for retaining rails that may be located therein.

DETAILED DESCRIPTION OF THE INVENTION

Figure 1:
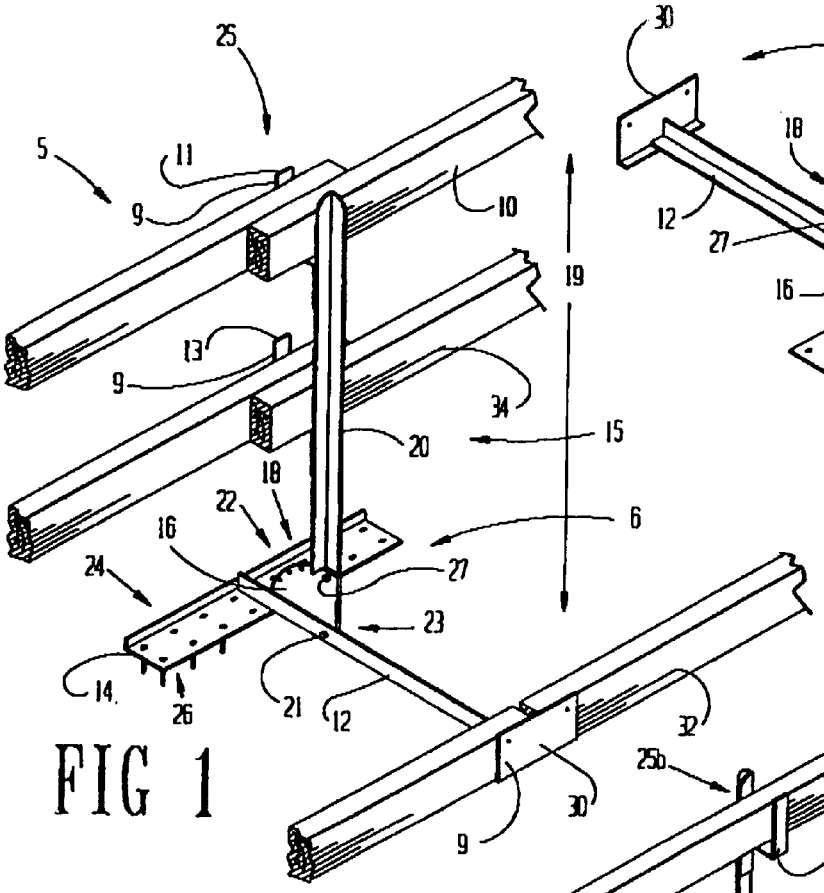
FIG. 1 is a perspective view of an anchor support holding first rail members, second rail members, and toe rail members.
Figure 2:
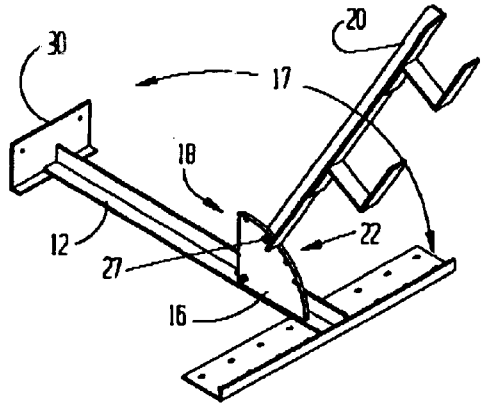
FIG. 2 is a side view of an anchor support with the elongated post in an adjusted position.

One embodiment of the present invention is illustrated in FIGS. 1 and 2. Referring now to FIG. 1, an anchor support or an adjustable rail support 15 is preferably made from various sized pieces of shaped steel welded and bolted together. It should be pointed out that the anchor support 15 could be manufactured from other materials such as metal rods, aluminum, angle iron, plastic or metal tubulars. Therefore, for the purpose of this description, the term "member", as used hereinafter, shall be understood to be possibly manufactured from any material suitable for construction of such a device, even though steel is presently preferred due to its strength. In addition, in the claims the elements have been recited as being "coupled"; the reason being that it is anticipated that elements may be connected together in such a way that there are other components interstitially located between the connected elements or that the elements may connect in fixed or movable relation one to the other.

Figure 3:
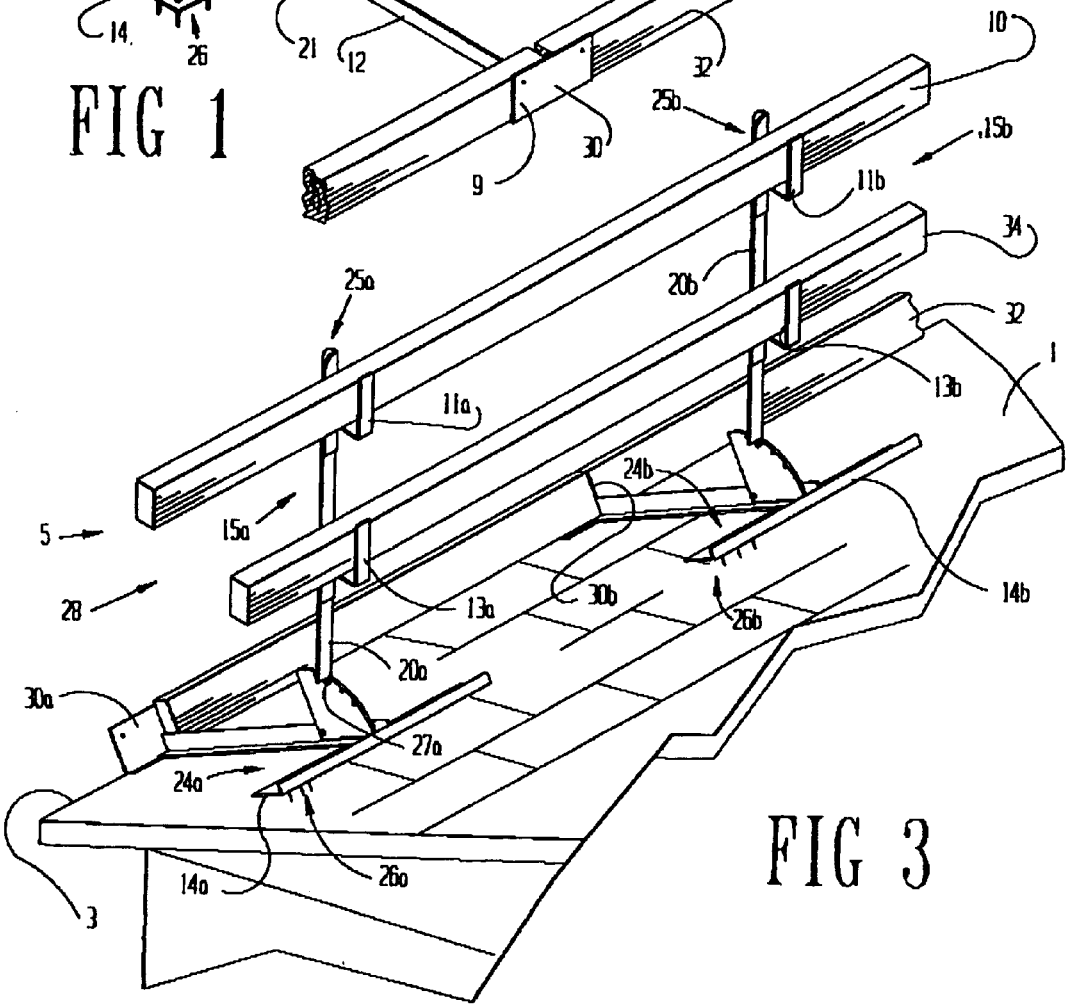
FIG. 3 is a perspective view of a plurality of anchor supports on a roof supporting a first rail member, a second rail member, and a toe rail member.

In FIG. 1, an anchor support 15 is shown. In one embodiment, the portable barricade or portable roofing safety device 5 is comprised of one anchor support 15 and rail members 10, 32 and 34. In this embodiment rail members 10, 32, and 34 need to be welded or bolted to anchor support 15 so that the rails 10, 32 and 34 can withstand a two hundred pound horizontal force. However, the preferred embodiment of the portable barricade 5 is illustrated in FIG. 3, where a first rail 10, a second rail 34, and a toe rail 32 are supported by a plurality of anchor supports 28 and hereinafter the preferred embodiment will be described.

Examining a single anchor support 15 in FIG. 1, support 15 includes a base 6 and elongated member, extension member or post 20. Base 6 includes base member 12, an anchor plate 14, an arch plate 16, and toe plate 30. The post 20 and base member 12 are constructed from two inch by two inch by three-eighth inch thick steel angle material. Arch plate 16 is constructed from 5/16 inch steel material and is welded to base member 12. Toe plate 30 is also welded to base member 12. Both toe plate 30 and anchor plate 14 are constructed from fourteen gage steel.

The elongated post 20 has a bottom end 23 which is connected to base member 12 by a first bolt 21 which is 3/8 inch in diameter and extends through post 20 and base member 12. In alternative embodiments, it is contemplated that post 20 can be located at various locations on member 12 including the center. Post 20 pivots with respect to member 12 at bolt 21. As shown by FIG. 2, the adjustable range of post 20 has a range of motion 17 from a position adjacent to toe plate 30 to a position over anchor plate 14 and generally parallel with base member 12. Arch plate 16 includes a first plurality of apertures 22 proximate to the arched perimeter or periphery 18 of arch plate 16. Post 20 can be positioned at various degrees depending on the pitch of the roof to be barricaded. As shown by FIG. 2, a second bolt 27 which is 3/8 inch in diameter can be used to lock post 20 in position by inserting second bolt 27 into post 20 and through one of the apertures 22 in plate 16. A spring-loaded pin can also be used instead of bolt 27 for positioning post 20. Post 20 is positioned in a substantially vertical orientation. The elongated post 20 can be adjusted for roofs with various pitches, including roofs ranging from a zero inch on twelve inch pitch to roofs with an eight inch on twelve inch pitch.

As shown by FIG. 1, anchor plate 14 contains a second plurality of apertures 24 to accommodate a plurality of nails 26. Nails 26 are used to fix support 15 to the roof. Sufficient numbers of nails 26 need to be used to fix support 15 to the roof so that support 15 can withstand a two hundred pound force applied to rails 10 and 34.

Receivers 9 are welded to a side of post 20 and to base member 12. Receivers 9 include a first rail bracket 11 and a second rail bracket 13. These brackets are constructed from 1/4 inch steel strap. The brackets 11 and 13 support rails 10 and 34 respectively. First rail bracket 11 is at least thirty-nine inches above the roof's surface 19. A third rail, toe rail 32, is supported by at least one receiver or toe plate 30. Toe rail 32 prevents items, such as tools, from sliding off the roof and landing on the workers below. Rails 10 and 34 per the regulations need to withstand a two-hundred pound force. This requirement can be 20 satisfied by using commercially available wood boards such as two by sixes (2×6). Rail 32 needs to prevent objects from sliding down and off the roof. Commercially available wood boards such as two by fours (2×4) can be used for rail 32. Since three or more supports 15 may be used in series, brackets 11 and 13 extend a slightly greater distance than four inches from post 20 so that the middle support in the series can accommodate more than one two by six inch rails as shown by FIG. 1. Rails 10, 32, and 34 must be number two grade or better, free of cracks or splits, and capable of resisting a two hundred pound horizontal force when installed.

For constructing a barricade 5 on a roof 1, it is preferred that a plurality of anchor supports 28 be used as illustrated by FIG. 3. To begin barricade 5, a first anchor support 15*a* is attached to the roof 1. The anchor is attached by nailing anchor plate 14*a* to the roof 1 by the use of nails 26*a* through apertures 24*a*. The support is positioned on the roof 1 by placing toe plate 30*a* parallel to and resting upon the eave of the roof 3. Anchor plate 14*a* will be parallel to the eave of the roof 3 and pointed toward the ridge of the roof 1. Elongated member 20*a* can be adjusted to the pitch of the roof 1 by removing second bolt 27*a* and positioning post 20*a* in a substantially vertical orientation 25*a*.

Once support 15*a* is anchored to the roof 1, a second anchor support 15*b* is position so that brackets 11*b* and 13*b*, and plate 30*b* will be generally aligned with brackets 11*a* and 13*a*, and plate 30*a* to allow the placement of rails 10, 34 and 32 in brackets 11*a* and 11*b*, 13*a* and 13*b*, and plates 30*a* and 30*b* respectively. Thus, if the eave of the roof 3 is substantially linear, then the second support 15*b* will also be positioned along the eave of the roof 3. The toe plate 30*b* will be placed along the eave 3, while anchor plate 14*b* will 20 be pointed toward the ridge of the roof 1. Support 15*b* is secured by nailing anchor plate 14*b* to the roof 1 by nails 26*b* through apertures 24*b*. Elongated member 20*b* is also adjusted to the pitch of the roof 1 so that member 20*b* is in a substantially vertical orientation 25*b*.

Once both supports 15*a* and 15*b* are aligned with each other as shown by FIG. 3, at least one rail 10 is placed on supports 15*a* and 15*b*. Preferably several rails 10, 34, and 32 are placed in brackets 11*a* and 11*b*, and 13*a* and 13*b*, and plates 30*a* and 30*b*. Rails 10 and 34 are held within the cupped portion or interior of brackets 11*a* and 11*b*, and 13*a* and 13*b* by gravity. No additional securing mechanism such as bolts or latches is needed. If a roofer looses balance and falls toward the eave of the roof 3, his fall will be stopped by impacting members 10 and 34.

To remove the supports 15*a* and 15*b*, rails 10, 34 and 32 are removed from brackets 11*a* and 11*b*, 13*a* and 13*b*, and plates 30*a* and 30*b* respectively. Next, nails 26*a* and 26*b* are removed from anchor plate 14*a* and 14*b* respectively. The supports 15*a* and 15*b* can now be moved to other locations on the roof 1 that need to be built or repaired. Referring to FIG. 1, for carrying and storing support 15, bolt 27 can be removed to allow pivoting of post 20 to a position over anchor plate 14 and parallel with base member 12.

The preferred embodiment of the invention has been shown and described, it will be apparent to those skilled in this art that various modifications may be made in the embodiment without departing from the spirit of the present invention. Therefore, the embodiments of the invention are defined as follows:

We claim:

1. A portable adjustable rail barricade for working on a roof, comprising:

a first base member fixedly interposed between a first anchor plate and a first toe plate, said first base member being adapted to maintain a substantial distance between said first anchor plate and said first toe plate;

a second base member fixedly interposed between a second anchor plate and a second toe plate, said second base member being adapted to maintain a substantial distance between said second base plate and said second toe plate;

said first and second anchor plates each having a plurality of attachment apertures therethrough, said attachment apertures being adapted for removable engagement of said first and second anchor plates with the upper surface of the roof;

a first anchor support pivotally attached to said first base member generally between said first anchor plate and said first toe plate and nearer said first anchor plate than said first toe plate;

a first arch plate fixedly attached to said first base member adjacent said first anchor support, said first arch plate having a plurality of adjustment apertures for maintaining said first anchor support in substantially any orientation between horizontal with respect to the roof and vertical with respect to the roof;

a first spring-loaded pin associated with said first anchor support for releasably engaging said adjustment apertures of said first arch plate and thereby adjustably maintaining said first anchor support in a particular orientation with respect to said first base member;

a second anchor support pivotally attached to said second base member generally between said second anchor plate and said second toe plate and nearer said second anchor plate than said second toe plate;

a second arch plate fixedly attached to said second base member adjacent said second anchor support, said second arch plate having a plurality of adjustment apertures for maintaining said second anchor support in substantially any orientation between horizontal with respect to the roof and vertical with respect to the roof;

a second spring-loaded pin associated with said second anchor support for releasably engaging said adjustment apertures of said second arch plate and thereby adjustably maintaining said second anchor support in a particular orientation with respect to said second base member;

a first rail member removably supported between a first rail bracket on said first anchor support and a second rail bracket on said second anchor support, said first and second rail brackets being sufficiently distal said base member to support said first rail member at a sufficient height to prevent roofers from falling over said first rail member when said first and second anchor supports are positioned in a substantially vertical orientation with respect to the roof;

a second rail member removably supported between a third rail bracket on said first anchor support and a fourth rail bracket on said second anchor support, said third rail bracket being interposed between said first rail bracket and said first base member and said fourth rail bracket being interposed between said second rail member and said second base member; and a toe rail removably supported substantially adjacent the surface of the roof between said first toe plate and said second toe plate.

* * * * *